US006819164B1

(12) United States Patent
Chen

(10) Patent No.: US 6,819,164 B1
(45) Date of Patent: Nov. 16, 2004

(54) APPARATUS AND METHOD FOR A PRECISION BI-DIRECTIONAL TRIM SCHEME

(75) Inventor: Sean S. Chen, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/274,313

(22) Filed: Oct. 17, 2002

(51) Int. Cl.[7] ..... G05F 1/10

(52) U.S. Cl. ..... 327/540; 327/543; 327/404; 323/312; 323/313; 323/315

(58) Field of Search ..... 327/538, 540, 327/543, 545, 546, 513, 403, 404, 416, 53, 66; 323/312–315

(56) References Cited

U.S. PATENT DOCUMENTS 5,004,971 A * 4/1991 Fitzpatrick et al. ..... 323/312
5,315,270 A * 5/1994 Leonowich ..... 331/1 A
5,717,321 A * 2/1998 Kerth et al. ..... 323/283
6,087,820 A * 7/2000 Houghton et al. ..... 323/315
6,163,184 A * 12/2000 Larsson ..... 327/156
6,265,859 B1 * 7/2001 Datar et al. ..... 323/315
6,388,494 B1 * 5/2002 Kindt et al. ..... 327/307
6,462,527 B1 * 10/2002 Maneatis ..... 323/315

* cited by examiner

*Primary Examiner*—Timothy P. Callahan
*Assistant Examiner*—An T. Luu
(74) *Attorney, Agent, or Firm*—Merchant & Gould; Joshua W. Korver

(57) ABSTRACT

A circuit is arranged to enable bi-directional trimming of a reference voltage. A trim current is generated by mirroring a bias current using one or more selectable current source circuits. The selectable current source circuits may each contain transistors that are sized differently from corresponding transistors of the other selectable current source circuits. The sizing may be arranged in a binary chain such that a range of currents may be generated for the trim current while allowing for selection of the level of adjustment for the reference voltage. The current selected for the trim current depends on which of the selectable current sources is enabled. The node corresponding to the trim current is selectively coupled to a load to either increase the voltage across the load or decrease the voltage across the load, providing bi-directional trimming of the reference voltage measured across the load.

20 Claims, 5 Drawing Sheets

APPARATUS AND METHOD FOR A PRECISION BI-DIRECTIONAL TRIM SCHEME

FIELD OF THE INVENTION

The present invention is generally related to trimming circuitry. More particularly, the present invention is related to bi-directionally trimming a reference.

BACKGROUND OF THE INVENTION

Common electronic circuits often require precision voltages and/or currents. For example, a shunt regulator may be arranged to regulate an output voltage by comparing the sensed input voltage to a reference voltage. The accuracy of the regulation is directly impacted by variations in the reference voltage. Improved accuracy can be achieved in a voltage reference through "trimmed" adjustments.

An example circuit for trimming a voltage reference includes a resistor chain with zener diodes, The zener diodes are coupled in parallel to each of the resistors on the chain. The reference voltage is trimmed by activating or deactivating a certain number of the zener diodes to adjust the reference voltage.

SUMMARY OF THE INVENTION

Briefly stated, a circuit is arranged to enable bi-directional trimming of a reference voltage. A trim current is generated by mirroring a bias current using one or more selectable current source circuits. The selectable current source circuits may each contain transistors that are sized differently from corresponding transistors of the other selectable current source circuits. The sizing may be arranged in a binary chain such that a range of currents may be generated for the trim current while allowing for selection of the level of adjustment for the reference voltage. The current selected for the trim current depends on which of the selectable current sources is enabled. The node corresponding to the trim current is selectively coupled to a load to either increase the voltage across the load or decrease the voltage across the load, providing bi-directional trimming of the reference voltage measured across the load.

In accordance with an aspect of the present invention, an apparatus includes a current source circuit that is arranged to provide a bias current to a load when active. A first selectable current source circuit is arranged to provide a first current when enabled. The first current corresponds to at least a portion of a trim current. The apparatus further includes a first switch circuit that is arranged to selectively couple the trim current to the load. The trim current is coupled to the load when the first switch circuit is closed increasing a voltage across the load. A second switch circuit is arranged to selectively couple the trim current to a current mirror circuit when the second switch circuit is closed. The current mirror circuit is arranged to draw current from the load decreasing the voltage across the load. The second switch circuit is closed when the first switch circuit is open, and the first switch circuit is closed when the second switch circuit is open.

In accordance with another aspect of the present invention, the apparatus further includes a second selectable current source circuit that is arranged to provide a second current when enabled. The sum of the first current and the second current correspond to the trim current. The first selectable current source circuit includes transistors that are sized differently than corresponding transistors of the second selectable current source circuit. The different sizing results in the first current and the second current being different.

In accordance with yet another aspect of the present invention, the apparatus includes a third selectable current source circuit that is arranged to provide a third current when enabled. The third current correspond to at least a portion of the trim current. Also, the first, second, and third selectable current source circuits are arranged in a binary chain.

In accordance with a further aspect of the present invention, the first selectable current source circuit includes two transistors. The first transistor is arranged to substantially mirror the bias current to produce the first current. The second transistor is arranged to operate as a switch for enabling and disabling the first selectable current source circuit. The second transistor is activated or deactivated by an enable signal so that the first current is decoupled from or coupled to a node that corresponds to the trim current. Alternatively, the first selectable current source circuit includes a transistor that is arranged to substantially mirror the bias current to produce the first current, a third switch circuit; and a fourth switch circuit. The third and fourth switch circuits are actuated to enable or disable the first selectable current source circuit. Additionally, the third switch circuit either couples the transistor to or decouples the transistor from the bias current when actuated. The fourth switch circuit activates or deactivates the transistor when actuated. The transistor is prevented from substantially mirroring the bias current when the transistor is deactivated.

The invention may also be implemented as methods that perform substantially the same functionality as the embodiments of the invention discussed above and below.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

According to the present invention, a bias current is produced in response to a reference, or bias, signal. The bias current is coupled to a load. Selectable current source circuits that produce currents related to the bias current are selectively activated. The currents produced by the selectable current source circuits are summed to produce a trim current. The trim current is provided to the load to either increase or decrease a voltage measured across the load.

In one embodiment, the selectable current source circuits are binary weighted and arranged in a binary chain. The binary weighted selectable current source circuits are selectively activated to adjust the trim current. The trim current is selectively coupled to the load to increase the voltage across the load. The trim current is coupled to a current mirror that is coupled to the load to decrease the voltage. Alternatively, another binary chain of selectable current source circuits is used to produce a second trim current. The second trim current may be coupled to the load at the same time the first trim current is coupled to the load depending on level of voltage adjustment selected. The first trim current increases the voltage by a first amount while the second trim current decreases the voltage by a second amount. The addition of the second trim current increases the granularity of adjustments to the voltage.

Figure 1:
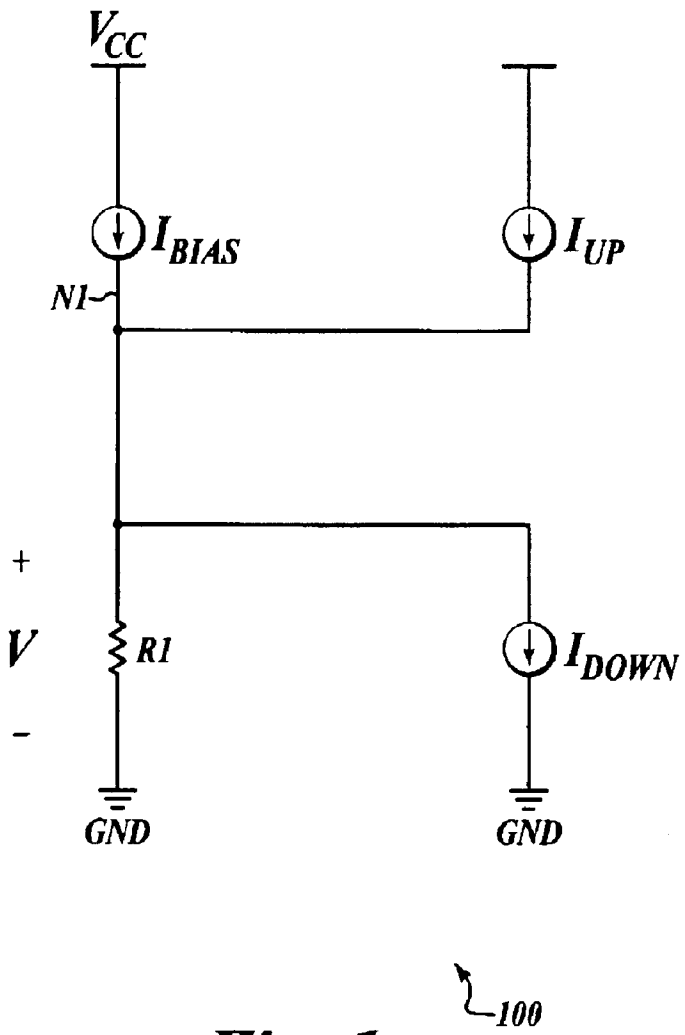
FIG. 1 illustrates a schematic diagram of an exemplary circuit arranged to provide bi-directional trimming of a bias current.

FIG. 1 illustrates a schematic diagram of an exemplary circuit that is arranged to provide bi-directional trimming of a bias current. The exemplary circuit (100) includes three current sources (Ibias, Iup, and Idown) that selectively operate on a load represented by resistor R1.

Current source Ibias is coupled between a power supply (Vcc) and node N1. Current source Iup is coupled between the power supply (Vcc) and node N1. Current source Idown is coupled between node N1 and a ground terminal (GND). Resistor R1 is coupled between node N1 and the ground terminal (GND).

The current from current source Tbias generates a voltage (V) across the load (R1). In one embodiment, the load is represented by circuitry other than the resistor (R1) shown. For example, the load may be represented by two resistors that separate the connections of current sources Iup and Idown to the load. In another embodiment, the output of the circuit is an output current generated as a result of the trimming of the voltage across the load. The voltage across the load is adjusted, or trimmed, by selectively adjusting the current sources Iup and Idown. Current from current source Iup is summed with the current provided by current source Ibias, such that the voltage across the load is adjusted by varying Iup. Alternatively, adjusting current source Idown subtracts from the current provided by current source Ibias, trimming the voltage across the load to a lower value. The apparatus and method for bi-directional trimming the voltage across the load are described in greater detail in the discussion of FIGS. 2–4.

Figure 2A:
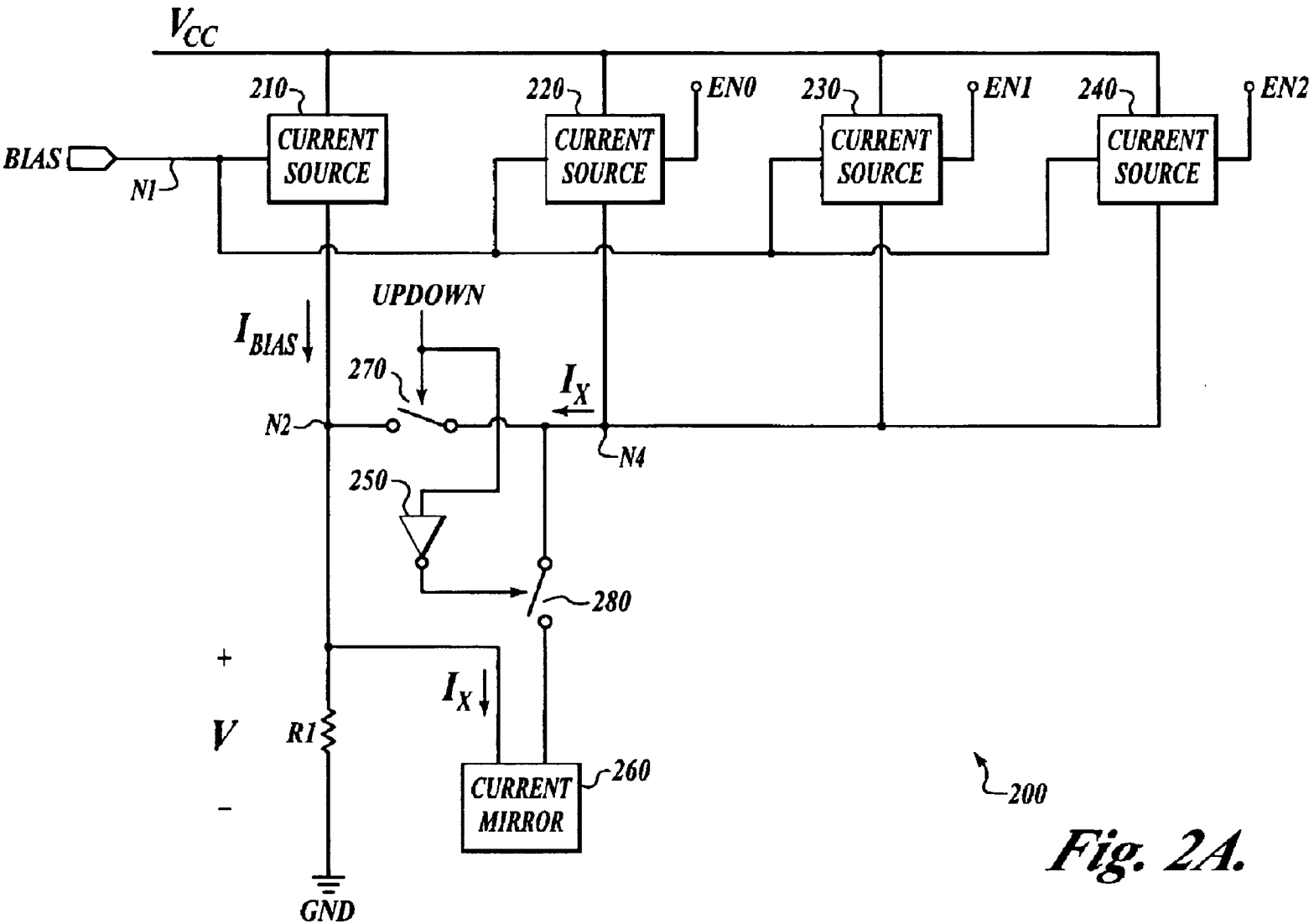
FIG. 2A shows a schematic diagram of an exemplary bi-directional trim circuit.

FIG. 2A shows a schematic diagram of an exemplary bi-directional trim circuit (200). Bi-directional trim circuit 200 includes a current source circuit 210, selectable current source circuits 220, 230, 240, inverter circuit 250, current mirror circuit 260, switch circuits 270 and 280, and a load (e.g., resistor R1).

Current source circuit 210 and selectable current source circuits 220, 230, 240 are each coupled to a power supply (Vcc). Current source circuit 210 provides current Ibias to node N2 in response to a bias signal (Bias). Each other current source circuit (220, 230, 240) produces currents that are summed together at node N4 to produce a trim current (Ix). Enable signals (e.g., EN0, EN1, EN2) selectively enable each of the current source circuits (220, 230, 240) to adjust trim current Ix.

Switch circuit 270 is responsive to a control signal (updown). Switch circuit 280 is response to an inverse of the control signal (updown), which is provided by inverter circuit 250. Switch circuits 270 and 280 selectively alternate between closed and open states. Switch circuit 270 is closed when switch circuit 280 is open, and switch circuit 270 is open when switch circuit 280 is closed.

Trim current Ix is summed with current bias when switch circuit 270 is closed and switch circuit 280 is open. The summed current is provided to the load (R1) such that the voltage across the load increases when current Ix is greater than zero. Alternatively, trim current Ix is coupled to current mirror 260 when switch circuit 270 is open and switch circuit 280 is closed. Current mirror 260 reflects trim current Lx to node N2 such that current Ix is subtracted from node N2. The voltage across the load decreases in response to the subtracted current when current Ix is greater than zero. The current that flows through the load depends on the magnitude if bias current Ibias and the magnitudes of the selected current source circuits that produce trim current Ix. The voltage across the load can be described according to the following equation when switch circuit 270 is closed and switch circuit 280 is open:

$$V=(Ibias+Ix)\cdot(R1) \quad (1)$$

Correspondingly, the voltage across the load can be described according to the following equation when switch circuit 280 is closed and switch circuit 270 is open.

$$V=(Ibias-Ix)\cdot(R1) \quad (2)$$

The number of current source circuits used to produce the trim current Ix may be increased or decreased as desired. The number of current source circuits used, increases or decreases the range of adjustment available for trimming the voltage across the load.

Figure 2B:
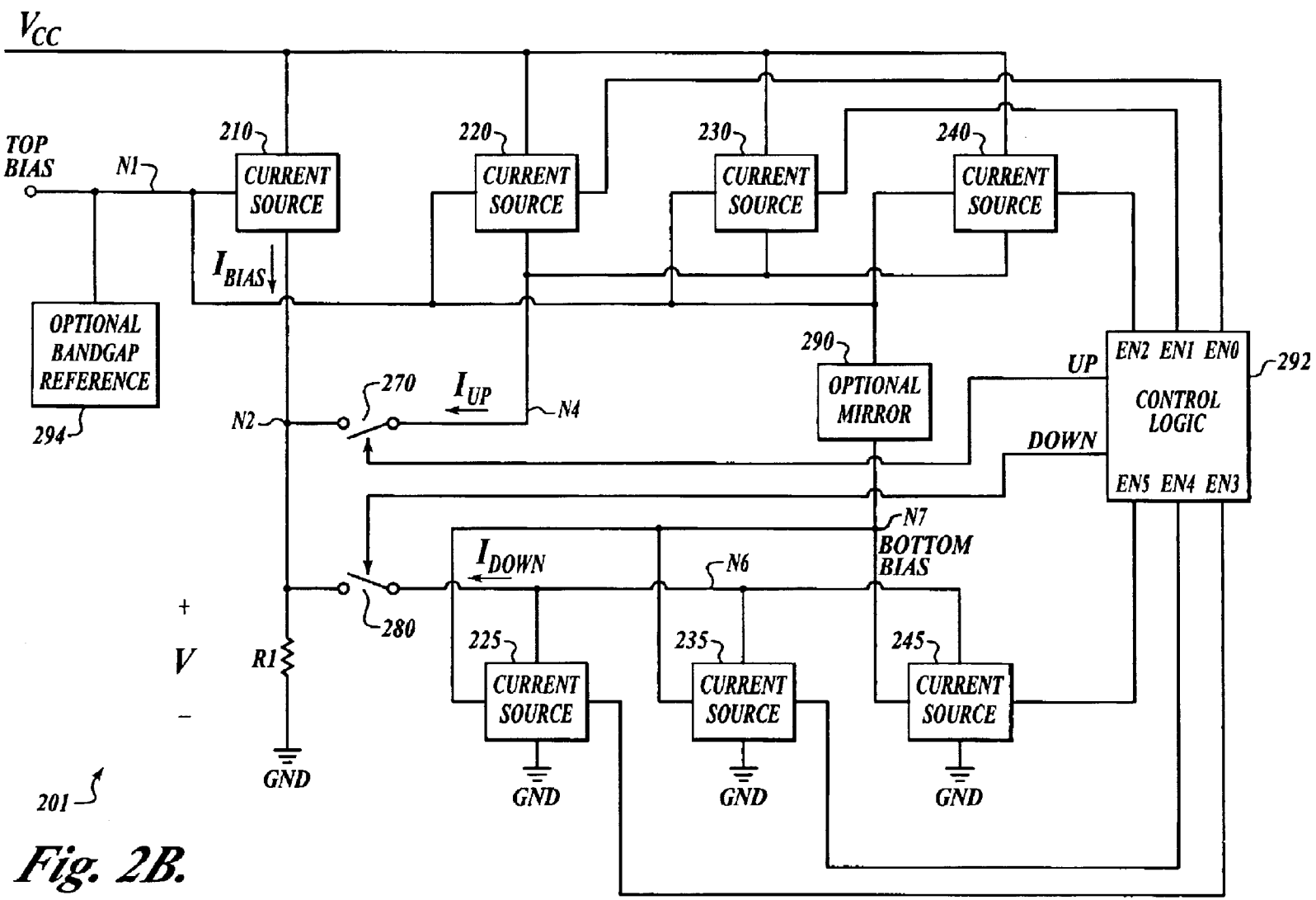
FIG. 2B shows a schematic diagram of another exemplary bi-directional trim circuit.

FIG. 2B shows a schematic diagram of an exemplary bi-directional trim circuit (201). Bi-directional trim circuit 201 includes a current source circuit 210, selectable current source circuits 220, 225, 230, 235, 240, 245, optional current mirror circuit 290, switch circuits 270 and 280, control logic circuit 292, optional bandgap reference circuit 294, and a load (e.g., resistor R1).

Bi-directional trim circuit 201 is connected and operates similarly to bi-directional trim circuit 200 shown in FIG. 2A. Additionally, a control logic circuit (292) is illustrated that produces the enables signals (EN0–EN5) for each of the selectable current source circuits (220, 225, 230, 235, 240, 245) and the control signals (up, down) for switch circuits 270 and 280. In another embodiment, the enable signals (EN0–EN5) and the control signals (up, down) are produced by separate control logic circuits (not shown).

Further, a bandgap reference circuit (294) may be used to produce the bias signal at node N1. Bandgap reference circuit 294 ensures that the voltage produced across the load in response to the bias current (Ibias) includes the advantages of a bandgap reference as well as the bi-directional trimming ability of the present invention.

In the embodiment shown, selectable current source circuits 220, 230, and 240 operate as described in connection with FIG. 2A to produce a first trim current (Iup). Selectable current source circuits 225, 235, and 245 are used to produce a second trim current (Idown), replacing current mirror 260 shown in FIG. 2A. Current mirror 290 reflects the bias signal (i.e., the top bias signal) of node N1 to node N7 to produce a bottom bias signal. Selectable current source circuits 225, 235, and 245 are responsive to the bottom bias signal in producing current Idown. As previously described in the discussion of FIG. 2A, trim current Iup is summed with current Ibias when switch circuit 270 is closed and switch circuit 280 is open. The summed current is provided to the load (R1) such that the voltage across the load (V) increases when current Iup is greater than zero. Correspondingly, trim current Idown is subtracted from node N2 when switch circuit 270 is open and switch circuit 280 is closed. The voltage across the load decreases in response to the subtracted current when current Idown is greater than zero.

In an alternative embodiment, switch circuit 270 and switch circuit 280 are closed at the same time (i.e., simultaneously). The voltage across the load (V) is adjusted both up and down with both switch circuit 270 and switch circuit 280 closed. The voltage (V) is increased corresponding to the magnitude of current Iup, and decreased according to the magnitude of current Idown. The voltage across the load can be described according to the following equation when both switch circuits 270 and 280 are closed:

$$V=(Ibias+up-Idown)\cdot R1 \quad (3)$$

Trimming the voltage (V) across the load (R1) both up and down at the sane time allows for increased granularity of adjustment. As an example, the voltage across the load generated in response to the bias current (Ibias) is 5 V. Current Iup is able increase the voltage in 1 V increments. Current Idown is able to decrease the voltage in 0.5 V increments. To reach a desired voltage of 7.5 V, both switch circuits 270 and 280 are closed, Iup is selected to increase the voltage by 3 V (e.g., 5+3=8), and Idown is selected to decrease the voltage by 0.5 V (e.g., 8–0.5=7.5). Other combinations of Iup and Idown may be used to achieve 7.5 V according to the logic used.

Figure 3:
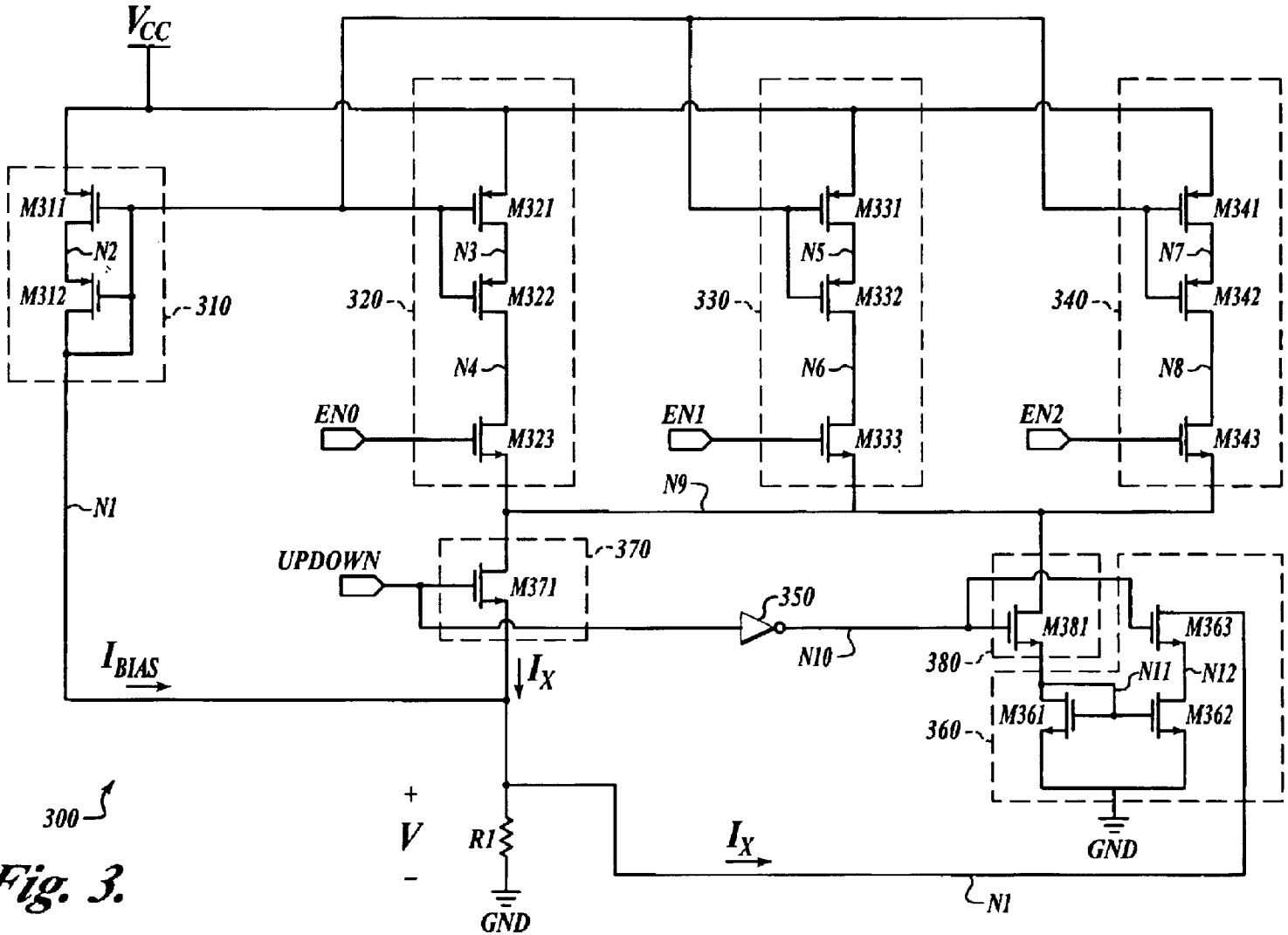
FIG. 3 illustrates a schematic diagram of an embodiment of a bi-directional trim circuit.

FIG. 3 illustrates a schematic diagram of an embodiment (300) of a bi-directional trim circuit. Bi-directional trim circuit 300 includes current source circuit 310, selectable current source circuits 320, 330, and 340, inverter circuit 350, current mirror circuit 360, switch circuits 370 and 380, and a load (e.g., resistor R1). Current source circuit 310 includes transistors M311 and M312. Selectable current source circuit 320 includes transistors M321–M323. Selectable current source circuit 330 includes transistors M331–M333. Selectable current source circuit 340 includes transistors M341–M343. Current mirror circuit 360 includes transistors M361–M363. Switch circuit 370 includes transistor M371. Switch circuit 380 includes transistor M381.

As previously described in connection with FIGS. 1 and 2, a bias current (Ibias) is coupled to the load (R1). The voltage (V) across the load may be increased or decreased according to a trim current (Ix).

The bias current (Ibias) is generated in response to current source circuit 310. The trim current (Ix) is produced by adding together the currents produced by each of the selectable current source circuits (320, 330, 340) at node N9. The transistors (M371 and M381) of switch circuits 370 and 380 are actuated according to a control signal (updown) and the inverse of the control signal respectively. In the embodiment shown, transistors M371 and M381 are not activated at the same time. When transistor M371 is activated, the current at node N9 is coupled to node N1, increasing the voltage (V) across the load (R1). When transistor M381 is activated, the current at node N9 is coupled to current mirror 360. The current through transistor M361 of current mirror 360 is reflected by transistor M362. Transistor M363 is activated when transistor M381 is activated. The current through transistor M362 pulls current Ix from the load (R1) decreasing the voltage across the load.

Each of the selectable current source circuits (320, 330, 340) used to produce trim current Ix may be selectively enabled or disabled. For example, in selectable current source circuit 320, transistors M321 and M322 are arranged to mirror the bias current (Ibias) to produce a proportional current at node N4. Transistor M323 is arranged to operate as a switch that is responsive to enable signal EN0. For a first value of enable signal EN0, transistor M323 is activated such that the current at node N4 is coupled to node N9. For a second value of enable signal EN0, transistor M323 is deactivated such that the current at node N4 is prevented from flowing to (e.g., isolated from) node N9. Each of the other selectable current source circuits (i.e., 330, 340) are arranged to operate similarly. In selectable current source circuit 330, transistors M331 and M332 are arranged to mirror the bias current (Ibias) while transistor M333 is arranged to operate as a switch. In selectable current source circuit 340, transistors M341 and M342 are arrange to mirror the bias current (Ibias) while transistor M343 is arranged to operate as a switch.

A current is provided to node N9 that corresponds to the selectable current source circuits (320, 330, 340) that are enabled according to enable signal EN0–EN2.

In one embodiment, the transistors are sized differently for each of the current source circuits (320, 330, 340) used to produce trim current Ix. By increasing the size of transistors M341 and M342 relative to transistors M331, and M332, current source circuit 340 may be arranged to provide a current that is larger than the current associated with current source circuit 330. The larger transistors increase the amount of current produced by the selectable current source circuit 340. The selectable current source circuits (320, 330, 340) may then be arranged as a binary chain according to the sizes of their respective transistors. For example, the currents produced by selectable current source circuit 320, 330, 340 may correspond to 1 mA, 2 mA, and 4 mA respectively, much like binary logic. Accordingly, an adjustable current may be provided to node N9 that may have a value in the range of 0 mA to 7 mA, with 1 mA increments, depending on the selected current source circuits (320, 330, 340) enabled.

The number of selectable current source circuits used may be increased or decreased as required. It is appreciated that the level of adjustment for trimming the voltage across the load is limited only by the practical size of bi-directional trim circuit 300. In theory, the number of selectable current source circuits may be increased to provide infinitely fine adjustment across an infinite range of currents for trimming the voltage across the load.

Figure 4:
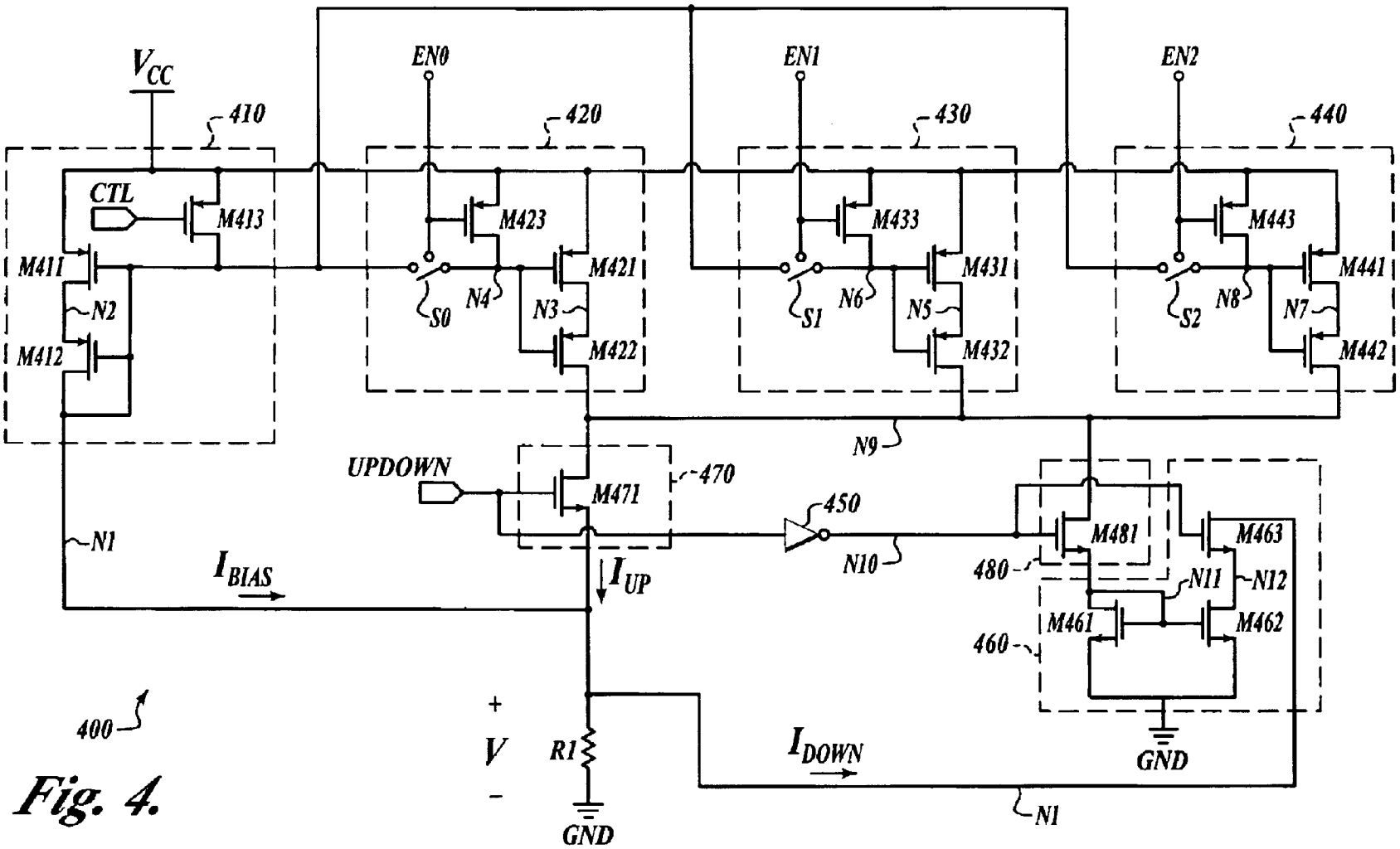
FIG. 4 shows a schematic diagram of another embodiment of a bi-directional trim circuit, in accordance with the present invention.

FIG. 4 shows a schematic diagram of another embodiment of a bi-directional trim circuit (400). Bi-directional trim circuit 400 includes current source circuits 410, selectable current source circuits 420, 430, and 440, inverter circuit 450, current mirror circuit 460, switch circuits 470 and 480, and a load (e.g., resistor R1). Current source circuit 410 includes transistors M411–M413. Selectable current source circuit 420 includes transistors M421–M423 and switch circuit S0. Selectable current source circuit 430 includes transistors M431–M433 and switch circuit S1. Selectable current source circuit 440 includes transistors M441–M443 and switch circuit S2. Current mirror circuit 460 includes transistors M461–M463. Switch circuit 470 includes transistor M471. Switch circuit 480 includes transistor M481.

Bi-directional trim circuit 400 of FIG. 4 operates similarly to bi-directional trim circuit 300 of FIG. 3. An alternate switching arrangement is provided in bi-directional trim circuit 400.

Each of the current source circuits (420, 430, 440) (i.e., selectable current source circuits), is enabled by the activation of two components arranged to operate as switches. For example, in selectable current source circuit 420, switch circuit S0 and transistor M423 are arranged to operate as switches. Switch circuit S0 and transistor M423 are responsive to signal EN0 such that switch circuit S0 is closed when transistor M423 is deactivated, and vice-versa. According to the switching scheme shown, transistors M421 and M422 mirror the bias current (Ibias) when S0 is closed and transistor M423 is deactivated. Transistors M421 and M422 are disabled when transistor M423 is active, which couples the gate terminals of transistors M421 and M422 to the power supply (Vcc). Selectable current source circuits 430 and 440 operate similarly. The arrangement of bi-directional trim circuit 400 allows each of the selectable current source circuits (420, 430, 440) to be constructed using only P-type transistors. Using only P-type transistors increases manufacturing efficiency of the circuit.

In addition, current source circuit 410 includes an additional transistor, transistor M413, as compared to current source circuit 310 of FIG. 3. Transistor M413 is responsive to a control signal (CTL). Transistor M413 shorts node N1 to Vcc when activated by the control signal (CTL), deactivating transistors M411 and M412. Accordingly, bi-directional trim circuit 400 may be selectively activated or deactivated in response to the control signal (CTL).

In light of the above description, it is understood and appreciated that the transistors of the circuits shown in FIGS. 3 and 4 may be bipolar junction transistors (BJT). When NPN transistors are employed, the entire system will be redesigned such that the p-type transistors are replaced with n-type transistors, and vice-versa. Additionally, it is understood and appreciated that the design may be further arranged to operate using other field effect transistor types including, but not limited to JFET transistors, GaAsFET transistors, and the like.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus, comprising:

a current source circuit that is arranged to provide a bias current to a load when active;

a first selectable current source circuit that is arranged to provide a first current when enabled, wherein the first current corresponds to at least a portion of a trim current;

a first switch circuit that is arranged to selectively couple the trim current to the load when the first switch circuit is closed such that a voltage across the load is increased;

a current mirror circuit; and a second switch circuit that is arranged to selectively coupled the trim current to the current mirror circuit when the second switch circuit is closed, wherein the current mirror circuit is arranged to draw current from the load such that the voltage across the load is decreased.

2. The apparatus of claim 1, wherein the second switch circuit is closed when the first switch circuit is open, and the first switch circuit is closed when the second switch circuit is open.

3. The apparatus of claim 1, further comprising a second selectable current source circuit that is arranged to provide a second current when enabled, wherein the second current corresponds to at least a portion of the trim current.

4. The apparatus of claim 3, wherein a sum of the first current and the second current correspond to the trim current.

5. The apparatus of claim 3, wherein the first selectable current source circuit includes transistors that are sized differently than corresponding transistors of the second selectable current source circuit such that the first current and the second current are different.

6. The apparatus of claim 3, further comprising a third selectable current source circuit that is arranged to provide a third current when enabled, wherein the third current corresponds to at least a portion of the trim current, and the first, second, and third selectable current source circuits are arranged in a binary chain.

7. The apparatus of claim 1, wherein the first selectable current source circuit comprises:

a first transistor that is arranged to substantially mirror the bias current to produce the first current; and a second transistor that is arranged to operate as a switch for enabling and disabling the first selectable current source circuit.

8. The apparatus of claim 7, wherein the second transistor is one of activated and deactivated by an enable signal such that the first current is one of decoupled from and coupled to a node that corresponds to the trim current.

9. The apparatus of claim 1, wherein the first selectable current source circuit comprises:

a transistor that is arranged to substantially mirror the bias current to produce the first current;

a third switch circuit; and a fourth switch circuit, wherein the third and fourth switch circuits are actuated to one of enable and disable the first selectable current source circuit.

10. The apparatus of claim 9, wherein the third switch circuit one of couples the transistor to and decouples the transistor from the bias current when actuated, and the fourth switch circuit one of activates and deactivates the transistor when actuated, such that the transistor is prevented from substantially mirroring the bias current when the transistor is deactivated.

11. A method for bi-directionally trimming a voltage, the method comprising:

generating a bias current;

coupling the bias current to a load such that the voltage is produced across the load in response to the bias current;

activating a first selectable current source to produce a first current, wherein the first current corresponds to at least a portion of a first trim current;

selectively coupling the first trim current to the load such that the voltage increases in response to the first trim current;

activating a second selectable current source circuit to produce a second current, wherein the second current corresponds to at least a portion of a second trim current; and selectively coupling the second trim current to the load such that the voltage decreases in response to the second trim current.

12. The method of claim 11, wherein the first trim current and the second trim current are corresponding currents mirrored by a mirror circuit.

13. The method of claim 11, further comprising a bandgap reference circuit for producing a first bias signal, wherein the bias current is produced in response to the first bias signal.

14. The method of claim 13, further comprising mirroring the first bias signal to produce a second bias signal, wherein the second trim current is produced in response to the second bias signal.

15. The method of claim 11, further comprising sizing transistors of the first selectable current source circuit differently than corresponding transistors of the second selectable current source circuit such that the first trim current is different from the second trim current.

16. The method of claim 11, further comprising a control logic circuit that produces a first enable signal, second enable signal, an up signal, and a down signal, wherein the first enable signal one of enables and disables the first selectable current source circuit, the second enable signal one of enables and disables the second selectable current source circuit, the up signal one of couples the first trim current to and decouples the first trim current from the load, and the down signal one of couples the second trim current to and decouples the second trim current from the load.

17. An apparatus for bi-directionally trimming a voltage that is provided across a load, the apparatus comprising:

a current source circuit that is coupled to the load;

a first selectable current source circuit that is coupled to a first node;

a first switch circuit that is arranged to selectively couple the first node to the load, whereby the voltage is increased;

a second selectable current source circuit that is coupled to a second node; and a second switch circuit that is arranged to selectively couple the second node the load, whereby the voltage is decreased.

18. The apparatus of claim 17, further comprising a third selectable current source circuit that is coupled to the first node, wherein a combination of a first current produced by the first selectable current source circuit and a second current produced by the third selectable current source circuit corresponds to a trim current produced at the first node.

19. The apparatus of claim 18, wherein the first selectable current source and the third selectable current source circuit are arranged in a binary chain.

20. The apparatus of claim 17, wherein the first node is coupled to the load while the second node is coupled to the load such that the voltage is increased a first level corresponding to a current at the first node and decreased a second level corresponding to a second current at the second node simultaneously.

* * * * *

UNITED STATES PATENT AND TRADEMARK OFFICE

CERTIFICATE OF CORRECTION

PATENT NO. : 6,819,164 B1
DATED : November 16, 2004
INVENTOR(S) : Sean S. Chen

It is certified that error appears in the above-identified patent and that said Letters Patent is hereby corrected as shown below:

Column 1,
Line 21, “diodes, The” should read -- diodes. The --.

Column 2,
Line 7, “correspond” should read -- corresponds --.

Column 3,
Line 20, “on level” should read -- on the level --.
Line 37, “Tbias” should read -- Ibias --.

Column 4,
Line 10, “Tbias” should read -- Ibias --.
Line 17, “Lx” should read -- Ix --.

Column 5,
Line 25, “sane” should read -- same --.

Signed and Sealed this

Fifth Day of April, 2005

JON W. DUDAS
*Director of the United States Patent and Trademark Office*